US005775516A

United States Patent [19]

McCumber et al.

[11] Patent Number: 5,775,516

[45] Date of Patent: Jul. 7, 1998

[54] BLISTER PACKAGE WITH PIVOTABLE DOOR CLOSURE

[75] Inventors: Donald E. McCumber; Charles Austen Angell, both of Madison, Wis.

[73] Assignee: Placon Corporation, Madison, Wis.

[21] Appl. No.: 889,427

[22] Filed: Jul. 8, 1997

[51] Int. Cl.[6] ..... B65D 73/00

[52] U.S. Cl. ..... 206/470; 206/467

[58] Field of Search ..... 206/470, 467, 206/461, 45.23

[56] References Cited

U.S. PATENT DOCUMENTS

| | | | |
|---|---|---|---|
| 3,061,082 | 10/1962 | Schenker . | |
| 3,391,783 | 7/1968 | Gantz | 206/467 X |
| 3,437,199 | 4/1969 | Jacobson . | |
| 3,473,655 | 10/1969 | Keating, Jr. . | |
| 3,581,885 | 6/1971 | Wald . | |
| 3,666,087 | 5/1972 | Cooper | 206/470 |
| 3,695,419 | 10/1972 | Packert et al. | 206/470 |
| 4,005,776 | 2/1977 | Seeley | 206/470 X |
| 4,119,203 | 10/1978 | Kuchenbecker . | |
| 4,200,193 | 4/1980 | Boyle . | |
| 4,236,637 | 12/1980 | Castner, Sr. et al. | 206/467 |
| 4,502,612 | 3/1985 | Morrison . | |
| 4,930,627 | 6/1990 | Borst et al. . | |
| 5,012,927 | 5/1991 | Borst . | |
| 5,147,035 | 9/1992 | Hartman | 206/470 X |
| 5,154,293 | 10/1992 | Gould . | |
| 5,311,990 | 5/1994 | Kalinski . | |
| 5,353,935 | 10/1994 | Yeager et al. . | |

*Primary Examiner*—Bryon P. Gehman
*Attorney, Agent, or Firm*—Lathrop & Clark

[57] ABSTRACT

A transparent thermoformed thermoplastic blister has a product bubble which protrudes from a flange which is connected to a backing card. The bubble has an access opening which is selectably uncovered by a pivotable door hinged to the flange and to a hinge panel by parallel hinges, with the hinge panel hinged to the flange to define an over-center hinge arrangement. The lengths of the hinge panel and door, as well as the spring constants of the hinges may be selected to form a closure which will tend to remain opened once opened, or alternatively one which will automatically spring closed when finger pressure on the door is released. The closure may alternatively be formed in a clamshell package. The physical manipulation of the door is similar to the throwing of a light switch, and hence is readily apprehended by new users.

47 Claims, 3 Drawing Sheets

BLISTER PACKAGE WITH PIVOTABLE DOOR CLOSURE

FIELD OF THE INVENTION

The present invention relates to thermoformed plastic blister packages in general, and to packages with reclosable openings in particular.

BACKGROUND OF THE INVENTION

Packages for point of purchase display must meet several demanding requirements if they are to play an effective part in product merchandising. When retail products were dispensed to customers by experienced salesman at specific customer request, simply marked plain boxes were a suitable storage container until time of sale. Yet the modem department store, convenience store, or hardware store is geared to largely unaided product selection by the customer. In the intensely competitive environment of the retail marketplace, a package should not only inform a customer of its contents, but should do so in an attractive and immediately comprehensible way. In addition, the package should make economical use of both display volume and materials.

Printed paperboard boxes must display the product only in the form of text and illustrations. Thermoformed transparent packages establish a more visceral connection between the customer and the product by presenting the product itself without any intermediary photographer or artist. Retained within a molded transparent plastic bubble the offered product is presented for visual inspection by the customer. Blister card packages, in which the molded blister is affixed to a stiff card, allow printed material containing size, price, and usage information to be juxtaposed with the actual product.

For many products the package serves only to contain the product over the course of its journey from manufacturer to consumer. Such a package is discarded and recycled once the product reaches its end user. Many products, however, are retained in the package for some time before consumption. Multiple small articles, for example, may be contained in a single package, for use over an extended period of time. Packages for these products then serve a double purpose: they display the product prior to sale, and retain and dispense the product after purchase by the consumer. A package that offers an appealing dispenser does more than just display the product, but actually adds value to the product by making its use easier or more convenient.

What is needed is a convenient product container which displays articles for consumer purchase while also providing for reclosable dispensing of the displayed articles in an efficient and comprehensible fashion.

SUMMARY OF THE INVENTION

The package of this invention has a door which is pivotable between an open and a closed position which can be operated with one hand or with two. The package may be formed as a thermoformed blister connected to a backing card. The blister has a protruding product bubble, with the door connected to a panel of the product bubble by a flexible hinge. A flange extends from the product bubble along the backing card, and a hinge panel is hinged to the flange and also hinged to the door along parallel U-shaped hinges. The door and hinge panel are in an over-center hinge arrangement with respect to the backing card and the product bubble. In a closed position, the hinge panel lies in the same plane as the flange, as the hinge panel is die cut from the material of the flange. In an opened position the hinge panel and door are pivoted frontwardly, and an opening to the product bubble may be reached beneath or to the side of the hinge panel and door. The lengths of the hinge panel and door, as well as the spring constants of the hinges may be selected to form a closure which will tend to remain open once opened, or alternatively one which will automatically spring closed when finger pressure on the door is released. The closure may be formed in the top or side of the blister, or may alternatively be formed in a clamshell package. The physical manipulation of the door is similar to the throwing of a light switch, and hence is readily comprehended by new users.

It is an object of the present invention to provide a package which may be opened and closed with one hand.

It is an additional object of the present invention to provide a blister package with a closure which will tend to stay in either an open or closed state until disturbed.

It is a further object of the present invention to provide a reclosable blister package which has a closure which tends to return to a closed state.

It is another object of the present invention to provide a thermoformed reclosable package which is conveniently filled with product.

It is a still further object of the present invention to provide a package which has an opening mechanism which is easily understood by new users.

It is additionally an object of the present invention to provide a package which has a closure mechanism which is convenient to the user physically from a human factors standpoint as well as being convenient cognitively through good product semantics to the user.

Further objects, features and advantages of the invention will be apparent from the following detailed description when taken in conjunction with the accompanying drawings.

DESCRIPTION OF THE PREFERRED EMBODIMENT

Figure 1:
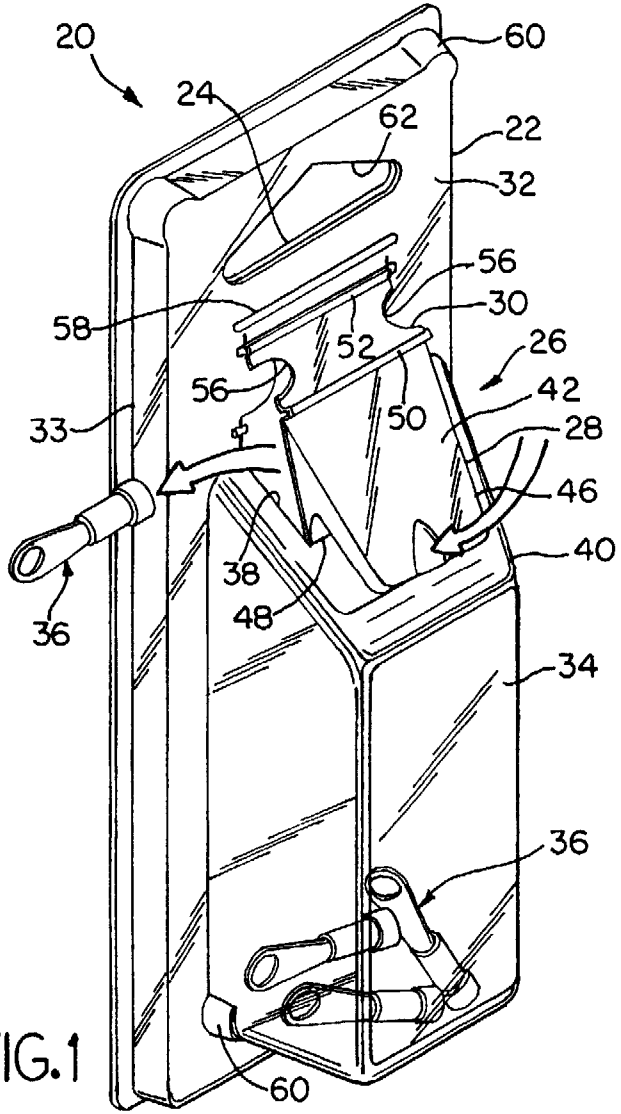
FIG. 1 is a front isometric view of the package of this invention with the pivotable door in an open position.

Referring more particularly to FIGS. 1–6 wherein like numbers refer to similar parts, a reclosable blister package 20 is shown in FIG. 1. The package 20 is comprised of a transparent thermoformed thermoplastic blister 22 which is connected to a paperboard backing card 24. The package 20 has a closure mechanism 26 which is comprised of a pivotable door 28 and a hinge panel 30 which are connected to the blister in an over-center hinge arrangement.

The blister 22 is affixed to the planar backing card 24 along a planar flange 32 which extends sidewardly from a product bubble 34. The connection may be by any conventional physical, chemical or mechanical means, for example, by adhesive, by heat sealing, by ultrasonic sealing, or by mechanical engagement. The flange 32 has a rearwardly extending skirt 33 which extends around the periphery of the card 24 and serves to block entrance to the package between the flange and the card. The product bubble 34 holds products 36 retained between the blister 22 and the backing card 24. Products 36 are dispensed from the package 20 through an access opening 38 defined in the top panel 40 of the product bubble 34. The door 28 is pivotable between an open position in which products may be discharged through the access opening, and a closed position in which the door blocks product movement through the access opening 38.

Figure 2:
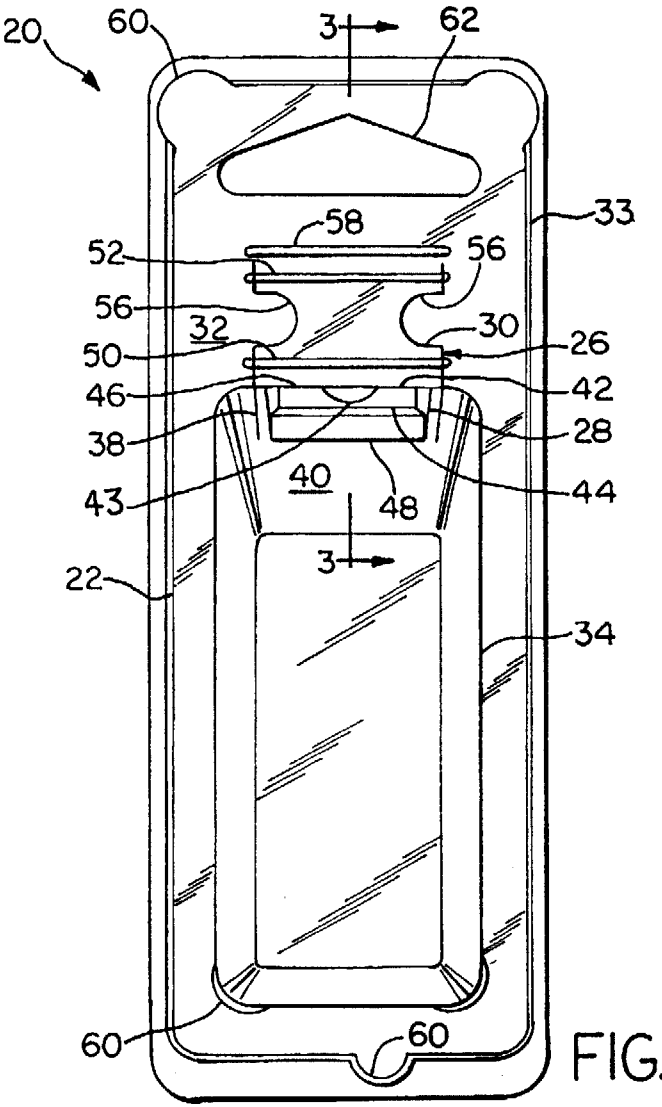
FIG. 2 is a front elevational view of the package of FIG. 1 with the pivotable door in a closed position.
Figure 4:
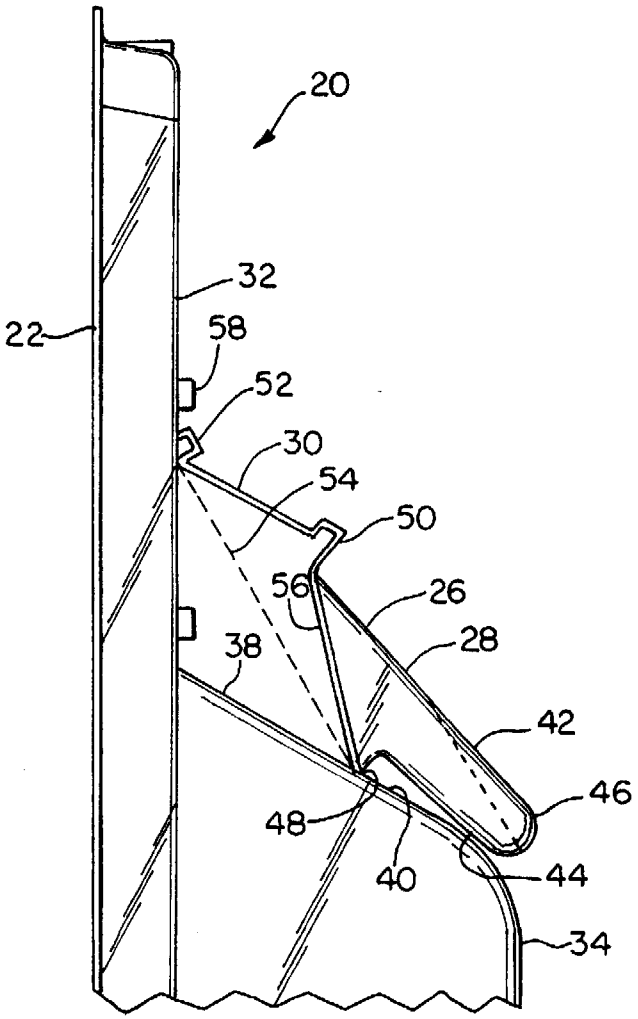
FIG. 4 is an enlarged fragmentary side elevational view of the package of FIG.1.

The over-center hinge arrangement of the door 28 and the hinge panel 30 serves to prevent the door from opening unintentionally, even though there is no snap connection or friction fit which holds the door closed. The over-center hinge arrangement of the closure mechanism 26 is best shown in FIG. 4. The door 28 is a protruding thermoformed shell which protrudes frontwardly from the product bubble 34. As shown in FIG. 2, the door 28 is preferably formed in the closed position such that neither the top wall 42 nor the bottom wall 44 of the door need to be undercut. The hollow shell structure of the door 28 renders it sufficiently stiff that the frontwardly protruding door top wall 42 serves as a lever 46 which provides leverage for overcoming the spring forces which are tending to hold the door closed. The top wall may be provided with a finger placement surface 43 which may be convex or concave and which indicates to the user appropriate placement of a finger or thumb for actuation of the closure. The door 28 is hinged to the product bubble top panel 40 along a flexible hinge line which defines a first hinge 48 which extends along the top panel beneath the protruding portions of the door. The first hinge 48 may be formed in various shapes known to the art, but a simple crease hinge is sufficient. The door top wall 42 is connected to the flange 32 by the hinge panel 30. The hinge panel 30 is connected to the door 28 by a second hinge 50 and is connected to the flange 32 by a third hinge 52. The first hinge 48, the second hinge 50, and the third hinge 52 are all substantially parallel to one another. The second hinge 50 and the third hinge 52 are U shaped hinges, comprised of two narrow plastic segments joined by a third perpendicular segment. Such hinges may be constructed of varying spring constants by adjusting the size of each segment, as well as the overall thickness and type of plastic material used.

An over-center hinge is, in essence, two relatively stiff members which are joined by a hinge, and each unconnected end of each member is hinged to a separate fixed structure in such a way that distance between the ends of the connected members is less than the combined length of the two members. If the hinges also have resilient properties, as will be present in a thermoformed thermoplastic blister, the over-center hinge can be designed to exhibit one or another desirable effect: either the connected members can be made to snap open or closed and stay in that position, or they can be made to return to an open or closed position.

Figure 3:
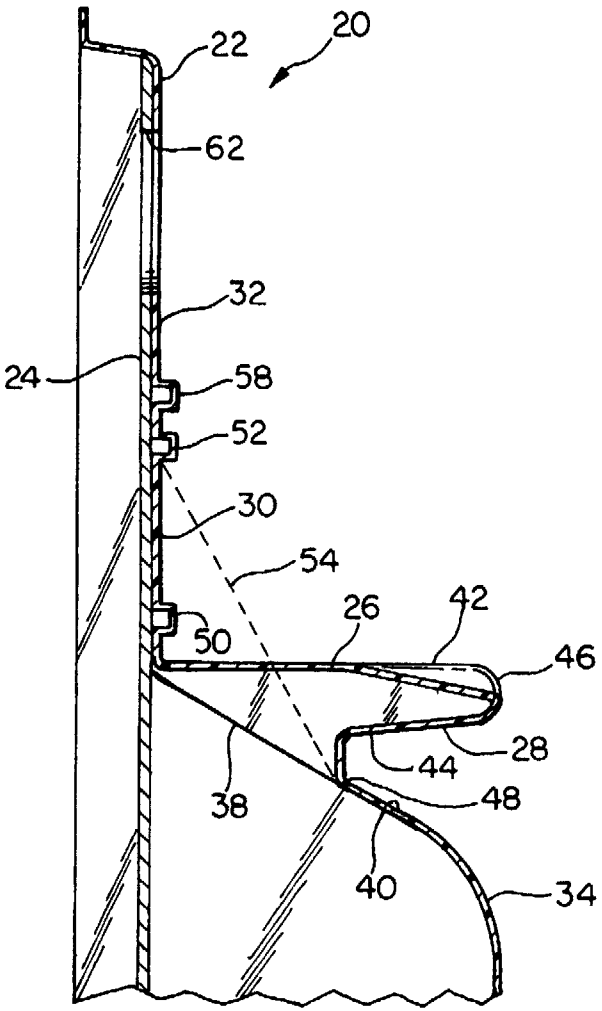
FIG. 3 is an enlarged fragmentary cross-sectional view of the package of FIG. 2 taken along section line 2—2.

The over-center hinge of the closure mechanism 26, as shown in FIGS. 3 and 4, is comprised of the hinge panel 30 and the door 28 connected at the first hinge 48 and the third hinge 52 to the generally rigid product bubble 34 and flange 32 respectively. The center of the closure mechanism 26 may be taken as a plane 54 which extends from the first hinge 48 to the third hinge 52. The two positions of the closure mechanism 26, open and closed, correspond to positions in which the second hinge 50 is rearward of the center plane 54 and in which the second hinge 50 is frontward of the center plane.

The plastic hinges of the blister have a spring memory, or tendency to return to their original position. The force exerted by this memory effect can be adjusted by varying the thickness and size of the plastic and the hinge structure. In addition, the performance of the closure mechanism 26 may be determined by selecting the lengths of the hinge panel 30 and the door 28 to control to what extend the combined length of the hinge panel and the door is greater than the distance between the first hinge 48 and the third hinge 52. The greater the combined length of the hinge panel and the door, the more likely the door will overcome the memory of the hinges and be pivotable into a positive open position.

The spring resilience of the first hinge 48, the second hinge 50 and the third hinge 52 and the lengths of the hinge panel 30 and the door 28 may be selected such that when the second hinge is displaced frontwardly of the center plane 54 the door 28 will continue to be urged into an open position and held in the open position until the door is manipulated to position the second hinge again rearwardly of the center plane. A closure with such properties will appear to snap open and remain open until positively closed.

Alternatively, the spring resilience of the first hinge 48, the second hinge 50 and the third hinge 52 and the lengths of the hinge panel 30 and door 28 may be selected so that when the second hinge is displaced frontwardly beyond the center plane 54 the door will continue to be urged into a closed position. Such a closure will thus remain closed unless an opening force is retained on the door lever.

As shown FIG. 2, in a closed position the second hinge 50 lies in substantially the plane of the flange 32 at a contact line above the access opening 38. The geometry of the closure mechanism 26 requires that the distance between the first hinge 48 and the third hinge 52 be less than the combined distance between the first hinge and the second hinge 50, and the second hinge and the third hinge. Because the hinge panel 30 and the door 28 are formed integrally with the blister 22 and separated from the blister by cut lines 56 on either side of the hinge panel 30 and the door 28, it will be seen that the distance between the first hinge 48 and the contact line added to the distance between the contact line and the third hinge 52, will also be greater than the distance between the first hinge and the third hinge. The cut lines 56 along the hinge panel 30, as best shown in FIG. 2, may be scalloped or concave outwardly between the third hinge 52 and the second hinge 50. The height and depths of these scallops may contribute to the resilient effects of the closure 26.

For effective and crisp operation of the snap open or snap close features of the closure 26, the flange 32 around the third hinge 52 should be retained rigidly against the backing card 24. The stiffness of the flange 32 in this location is preserved by positioning a protruding stiffening rib 58 to extend from the flange immediately above the third hinge 52 and is preferably parallel to the third hinge. The rib 58 may be similar in shape to the third hinge itself, but the stiffening rib 58 does not intersect with the cut lines 56 and thus contributes to the stiffness of the flange 32.

The door bottom wall 44 protrudes frontwardly above the bubble top panel 40, and, in the door opened position, is disposed in close proximity to or against the bubble top panel. The frontwardly protruding top wall 42 of the door 28 with the bottom wall 44 define a lever 46 with a forwardmost portion which in the door closed position is above the first hinge 48, and which in the door open position is below the first hinge. This lever structure provides leverage to the user to overcome the spring forces of the closure which are tending to hold the door in the closed position. In addition, consumers are familiar with the operation of lever from the many mechanical and electrical devices which rely on levers for operation. The nonverbal communications between a physical object and consumer are known as product semantics. Effective product semantics make it possible for a user to use a new package with little written instruction. A light switch for example has a protruding lever which is depressed or raised to turn on and off a light. The similarity in appearance of the door lever and a light switch helps to immediately convey to a customer the operation of the closure.

The blister may also be provided with denesting lugs 60 to prevent nested blisters from becoming too intimately engaged in shipment. The lugs 60 may be negative draft protrusions, or the lugs may be formed in different positions on alternating parts in a run to achieve a positive separation between nested blisters. A hang hole 62 may be provided in the blister and the card above the bubble for display of the package in a retail environment.

To package products in the blister 22, the blister is positioned with the product bubble 34 protruding downwardly, product 36 is introduced into the bubble, and the card 24 is affixed to the back of the blister.

For certain products, customers may desire some physical assurance that the package has not been opened by another prior to sale. The package 20 may be made tamper evident by affixing the hinge panel 30 with a small spot of adhesive or by heat or ultrasonic sealing to the backing card 24 in the door closed position. This affixation serves to retain the package 20 in the closed position, yet the connection is selected of a sufficiently low yield strength that pivoting the door 28 easily opens the package. Furthermore, the bond between the paper of the backing card 24 and the hinge panel 30 should be such that opening the door 28 causes a portion of the backing card 24 to remain attached to the hinge panel 30. The presence of this small spot of paper on the unconnected hinge panel 30 will provide evidence to a consumer of prior opening of the door.

A customer wishing to dispense products from the package presses on the lever 46 of the door 28, thereby revealing the access opening 38. Products 36 may be dislodged from the product bubble 34 by tipping or inverting the package 20. The package 20 will be particularly advantageous for dispensing products which are significantly smaller than the access opening 38. However, the closure 26 may be designed with appropriate dimensions to suit the sizes of the products to be contained within the package.

Figure 6:
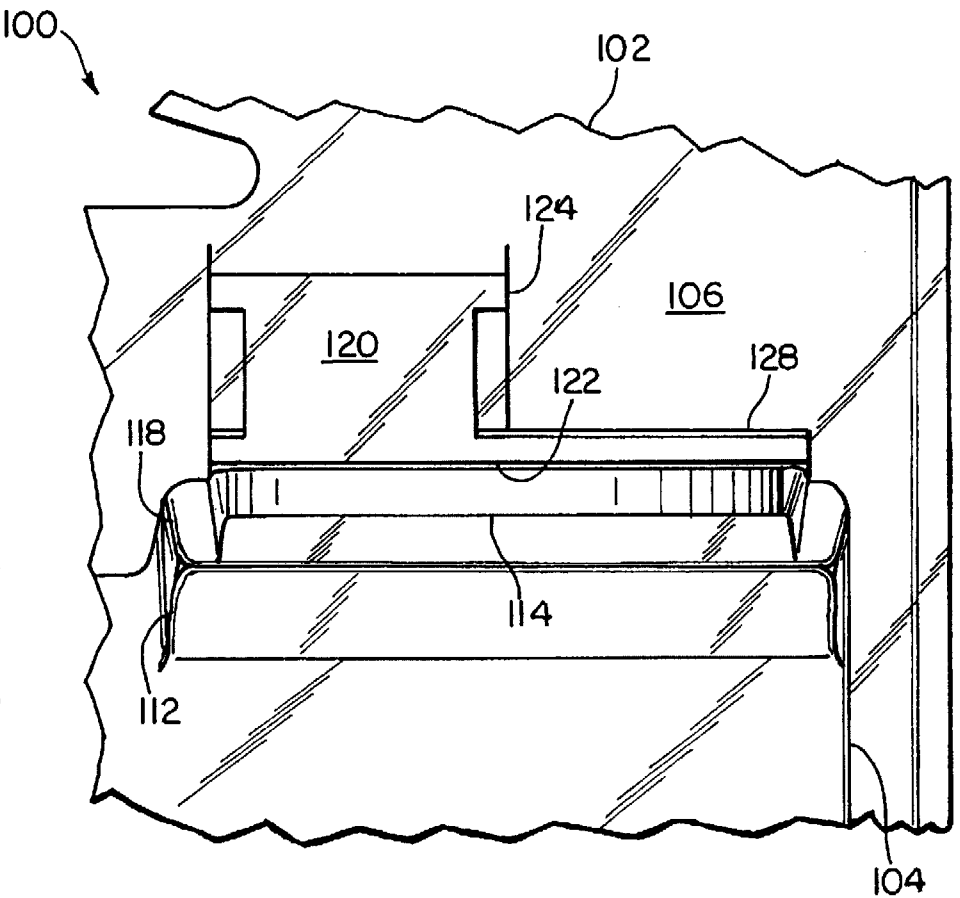
FIG. 6 is an enlarged fragmentary front elevational view of the package of FIG. 5 in a closed position.
Figure 5:
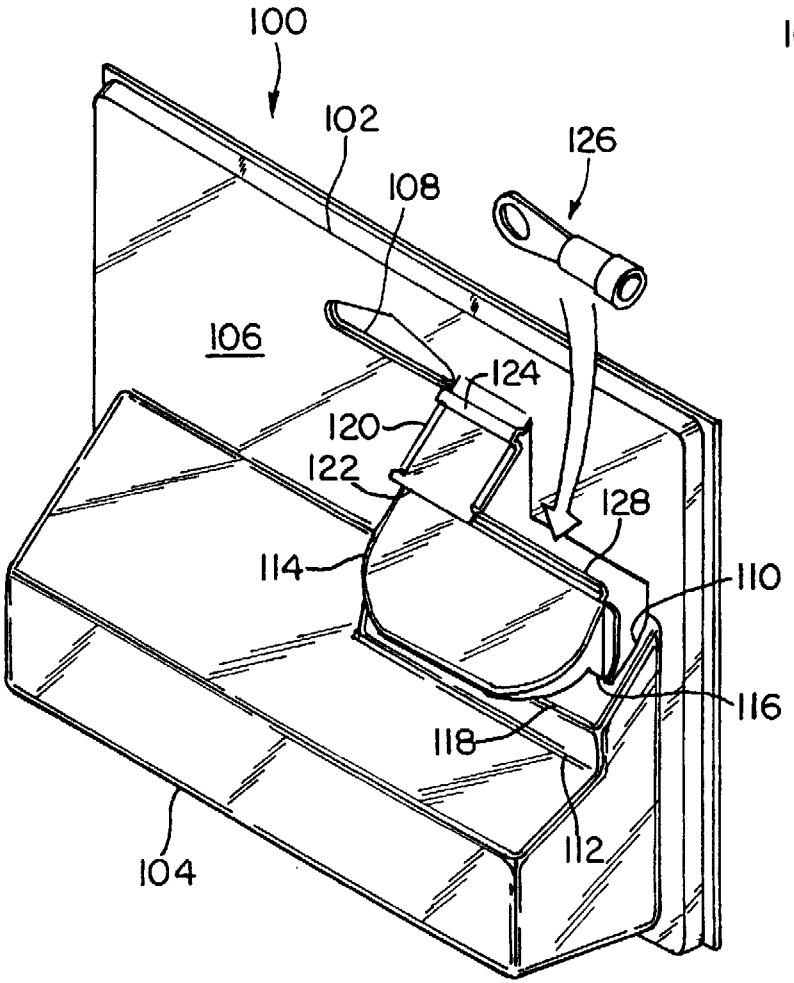
FIG. 5 is a front elevational view of an alternative embodiment package of this invention with the latch in an open position.

An alternative embodiment package 100 of this invention having an access opening which is larger than the hinge panel is shown in FIGS. 5 and 6. The package 100 has a thermoformed thermoplastic blister 102 with a product bubble 104 which protrudes frontwardly from a planar flange 106. The flange 106 is affixed to a paperboard backing card 108. The blister 102 is an example of a package for applications requiring an elongated product bubble 104. The product bubble 104 has an upwardly facing access opening 110, shown in FIG. 5. The access opening 110 may be positioned in the top panel of the product bubble, or, as in the package 100 shown, the access opening 110 is formed in a protrusion 112 from the main product bubble which adds stiffness to the access opening. A pivotable door 114 is connected by a first hinge 116 to the top panel 118 of the protrusion 112. A hinge panel 120 extends from the door along a second hinge 122 which is approximately parallel to the first hinge. The hinge panel 120 is connected to the blister flange 106 along a third hinge 124.

The package 100 permits products 126 to be extracted from the product bubble directly upwardly by making the door 114 wider than the width of the second hinge 122. As shown in FIG. 6, the upper lip 128 of the door 114 extends at approximately the level of the second hinge, and is formed in the thermoforming mold to extend approximately in the same plane as the flange 106. In the same cutting step which separates the hinge panel 120 from the flange 106, the door 114 is separated from the flange as well. The package 100 may be better suited to elongate articles, which are more easily extracted through a lengthened opening between the door 114 and the backing card 108.

The blisters of this invention are particularly suited to economical manufacture by the thermoforming method. In thermoforming, a thermoplastic sheet of material is heated and then drawn over a metal mold. The softened plastic conforms to the mold, cools, and is then separated from the mold and cut and trimmed as necessary. The blister may be formed of any conventional thermoplastic material depending on the specific package need, for example polyethylene (PET), recycled polyethylene (RPET), PETG, Styrene, HIPS (high impact polystyrene), modified polystyrene, polyvinyl chloride (PVC) and other assorted sheet thermoformable materials. Although for many uses the package will be formed of transparent or semitransparent sheet plastic material, it may also be formed of opaque plastic material where desired.

It should be noted that although the package closure of this invention has been illustrated as part of a blister package, it may also be employed as a part of other types of thermoformed plastic packages, for example as part of a clamshell package. In addition, although the closure has been illustrated on a top panel of product bubble, the closure may also be provided on the side, bottom or front of the bubble. Furthermore, the hinges may be positioned on a panel of the bubble which serves as a flange to the closure, as well as on the flange which connects to the backing card.

It is understood that the invention is not limited to the particular construction and arrangement of parts herein illustrated and described, but embraces such modified forms thereof as come within the scope of the following claims.

We claim:

1. A package comprising:

a product bubble which protrudes frontwardly from a flange, the product bubble having a top panel which extends frontwardly from the flange, wherein portions of the top panel define an access opening which opens into the product bubble;

a protruding door member which extends from the top panel along a first hinge; and a hinge panel which extends from the door member along a second hinge positioned above the first hinge, the hinge panel being connected to the flange at a third hinge which is above the second hinge, wherein the first hinge, the second hinge, and the third hinge are substantially parallel to one another, and wherein the door member is pivotable about the first hinge to selectably reveal and close the bubble access opening.

2. The package of claim 1 wherein the flange encircles the product bubble, and wherein a backing card is fixed to the flange to close the product bubble.

3. The package of claim 1 wherein the hinge panel is affixed to the backing card in the door closed position, the affixing serving to retain the package in the closed position, and wherein the opening of the door causes a portion of the backing card to remain attached to the hinge panel thereby indicating prior opening of the door.

4. The package of claim 2 further comprising a peripheral skirt which extends rearwardly from the flange to surround the backing card, the skirt restricting access between the card and the flange.

5. The package of claim 1 wherein in a closed position the second hinge lies in substantially the plane of the flange at a contact line above the access opening, and wherein a first distance is defined between the first hinge and the third hinge;

a second distance is defined between the first hinge and the second hinge;

a third distance is defined between the second hinge and the third hinge;

a fourth distance is defined between the first hinge and the contact line; and a fifth distance is defined between the contact line and the third hinge, the combined second distance and the third distance being greater than the first distance.

6. The package of claim 5 wherein the sum of the second distance and the third distance is equal to the sum of the fourth distance and the fifth distance.

7. The package of claim 6 wherein the second distance is equal to the fourth distance, and the third distance is equal to the fifth distance.

8. The package of claim 1 wherein the door member has portions which protrude frontwardly above the bubble top panel, and wherein in the door opened position, the frontwardly protruding portions are disposed in close proximity to the top panel.

9. The package of claim 8 wherein the door frontwardly protruding portions define a lever with a forwardmost portion which, in the door closed position is above the first hinge, and which in the door open position is below the first hinge.

10. The package of claim 1 wherein the spring resilience of the first hinge, the second hinge and the third hinge are selected such that when the second hinge is displaced frontwardly of a center plane extending between the first hinge and the third hinge, the door will continue to be urged into an open position and retained therein until the door is manipulated to position the second hinge rearwardly of the center plane.

11. The package of claim 1 wherein the spring resilience of the first hinge, the second hinge and the third hinge are selected such that when the second hinge is displaced frontwardly of a center plane extending between the first hinge and the third hinge, the door will be urged into a closed position if frontward pressure is released.

12. The package of claim 1 wherein the hinge panel lies in the same plane as the flange in the door closed position.

13. The package of claim 1 wherein the width of the door member along the direction of the first hinge is greater than the width of the hinge panel and the first hinge, the access opening being revealed upwardly when the door member is pivoted into an open position.

14. The package of claim 1 further comprising a stiffening ridge which protrudes frontwardly from the flange above the third hinge, the stiffening ridge extending substantially parallel to the third hinge.

15. The package of claim 1 wherein the first hinge is a creased hinge, and wherein the second hinge and the third hinge are U-shaped hinges.

16. A thermoformed thermoplastic unitary blister comprising:

a blister flange;

a hinge panel which is positionable coplanar with the flange, and which is severed from the flange on two sides;

a product bubble which protrudes frontwardly from the flange, the product bubble having portions which define an access opening into the product bubble;

a door which extends from the product bubble above the access opening, the door extending from the product bubble along a first hinge, and extending from the hinge panel along a second hinge, the hinge panel being pivotable with respect to the flange about a third hinge which is positioned on the flange, the door being pivotable between a first position in which the door closes and blocks access to the access opening, and a second position in which the access opening is revealed, the door being connected to the hinge panel and the product bubble in both the first position and the second position.

17. The blister of claim 16 wherein the first hinge, the second hinge and the third hinge are substantially parallel.

18. The blister of claim 16 wherein the flange encircles the product bubble, and wherein a backing card is fixed to the flange to close the product bubble.

19. The package of claim 18 wherein the hinge panel is affixed to the backing card in the door closed position, wherein the opening of the door causes a portion of the backing card to remain attached to the hinge panel thereby indicating prior opening of the door.

20. The blister of claim 18 further comprising a peripheral skirt which extends rearwardly from the flange to surround the backing card, the skirt restricting access between the card and the flange.

21. The blister of claim 16 wherein in a closed position the second hinge lies in substantially the plane of the flange at a contact line above the access opening, and wherein a first distance is defined between the first hinge and the third hinge;

a second distance is defined between the first hinge and the second hinge;

a third distance is defined between the second hinge and the third hinge;

a fourth distance is defined between the first hinge and the contact line; and a fifth distance is defined between the contact line and the third hinge, the combined second distance and the third distance being greater than the first distance.

22. The blister of claim 21 wherein the sum of the second distance and the third distance is equal to the sum of the fourth distance and the fifth distance.

23. The blister of claim 22 wherein the second distance is equal to the fourth distance, and the third distance is equal to the fifth distance.

24. The blister of claim 16 wherein the door member has portions which protrude frontwardly above the bubble, and wherein when the door is in the second position, the frontwardly protruding portions are disposed in close proximity to the bubble.

25. The blister of claim 24 wherein the door frontwardly protruding portions define a lever with a forwardmost portion which, in the door first position is above the first hinge, and which in the door second position is below the first hinge.

26. The blister of claim 16 wherein the spring resilience of the first hinge, the second hinge and the third hinge are selected such that when the second hinge is displaced frontwardly of a center plane extending between the first hinge and the third hinge, the door will continue to be urged into an open position and retained therein until the door is manipulated to position the second hinge rearwardly of the center plane.

27. The blister of claim 16 wherein the spring resilience of the first hinge, the second hinge and the third hinge are selected such that when the second hinge is displaced frontwardly of a center plane extending between the first hinge and the third hinge, the door will be urged into a closed position if frontward pressure is released.

28. The blister of claim 16 wherein the hinge panel lies in the same plane as the flange in the door first position.

29. The blister of claim 16 wherein the width of the door member along the direction of the first hinge is greater than the width of the hinge panel and the first hinge, the access opening being revealed upwardly when the door member is pivoted into an open position.

30. The blister of claim 16 further comprising a stiffening ridge which protrudes frontwardly from the flange above the third hinge, the stiffening ridge extending substantially parallel to the third hinge.

31. The blister of claim 16 wherein the first hinge is a creased hinge, and wherein the second hinge and the third hinge are U-shaped hinges.

32. A blister package comprising:

a backing card; and a thermoformed thermoplastic unitary blister having a flange which is engaged with the backing card, and a bubble protruding from the flange, the bubble having a bubble panel which extends away from the flange and has portions defining an access opening into the bubble, the access opening being selectably covered and uncovered by a door which is hinged to the bubble panel, the door being connected along a first hinge to the bubble panel, and along a second hinge to a hinge panel, the hinge panel being connected along a third hinge to the flange, the door being pivotable between a closed position in which the door closes and blocks access to the access opening, and an open position in which the access opening is revealed.

33. The blister package of claim 32 wherein the first hinge is spaced frontwardly and below the third hinge.

34. The blister package of claim 32 wherein in the closed position the second hinge lies in substantially the plane of the flange at a contact line above the access opening, and wherein a first distance is defined between the first hinge and the third hinge;

a second distance is defined between the first hinge and the second hinge;

a third distance is defined between the second hinge and the third hinge;

a fourth distance is defined between the first hinge and the contact line; and a fifth distance is defined between the contact line and the third hinge, the combined second distance and the third distance being greater than the first distance.

35. The blister package of claim 34 wherein the sum of the second distance and the third distance is equal to the sum of the fourth distance and the fifth distance.

36. The blister package of claim 35 wherein the second distance is equal to the fourth distance, and the third distance is equal to the fifth distance.

37. The blister package of claim 32 wherein the spring resilience of the first hinge, the second hinge and the third hinge are selected such that when the second hinge is displaced frontwardly of a center plane extending between the first hinge and the third hinge, the door will continue to be urged into an open position and retained therein until the door is manipulated to position the second hinge rearwardly of the center plane.

38. The blister package of claim 32 wherein the spring resilience of the first hinge, the second hinge and the third hinge are selected such that when the second hinge is displaced frontwardly of a center plane extending between the first hinge and the third hinge, the door will be urged into a closed position if frontward pressure is released.

39. The blister package of claim 32 wherein the width of the door member along the direction of the first hinge is greater than the width of the hinge panel and the first hinge, the access opening being revealed upwardly when the door member is pivoted into an open position.

40. The blister package of claim 32 further comprising a stiffening ridge which protrudes frontwardly from the flange above the third hinge, the stiffening ridge extending substantially parallel to the third hinge.

41. The blister package of claim 32 wherein the first hinge is a creased hinge, and wherein the second hinge and the third hinge are U-shaped hinges.

42. A package comprising:

a backing card;

a product bubble having a flange connected to the backing card, the bubble protruding frontwardly from the flange, and the product bubble having a top panel which extends frontwardly from the card, wherein portions of the top panel define an access opening which opens into the product bubble;

a protruding door member which extends from the top panel along a first hinge; and a hinge panel which extends from the door member along a second hinge positioned above the first hinge, the hinge panel being connected to the card at a third hinge which is above the second hinge, wherein the first hinge, the second hinge, and the third hinge are substantially parallel to one another, and wherein the door member is pivotable about the first hinge to selectably reveal and close the bubble access opening.

43. The package of claim 42 wherein in a closed position the second hinge lies in substantially the plane of the flange at a contact line above the access opening, and wherein a first distance is defined between the first hinge and the third hinge;

a second distance is defined between the first hinge and the second hinge;

a third distance is defined between the second hinge and the third hinge;

a fourth distance is defined between the first hinge and the contact line; and a fifth distance is defined between the contact line and the third hinge, the combined second distance and the third distance being greater than the first distance.

44. The package of claim 43 wherein the door frontwardly protruding portions define a lever with a forwardmost portion which, in the door closed position is above the first hinge, and which in the door open position is below the first hinge.

45. The package of claim 43 wherein the spring resilience of the first hinge, the second hinge and the third hinge are selected such that when the second hinge is displaced frontwardly of a center plane extending between the first hinge and the third hinge, the door will continue to be urged into an open position and retained therein until the door is manipulated to position the second hinge rearwardly of the center plane.

46. The package of claim 43 wherein the spring resilience of the first hinge, the second hinge and the third hinge are selected, such that when the second hinge is displaced frontwardly of a center plane extending between the first hinge and the third hinge, the door will be urged into a closed position if frontward pressure is released.

47. The package of claim 43 wherein the width of the door member along the direction of the first hinge is greater than the width of the hinge panel and the first hinge, the access opening being revealed upwardly when the door member is pivoted into an open position.

* * * * *